United States Patent [19]

Nomura et al.

[11] 4,094,135

[45] June 13, 1978

[54] SWITCH CONTROL UNIT FOR ELECTRONIC TIMEPIECE

[75] Inventors: Yasushi Nomura, Tokorozawa; Shigeru Morokawa, Higashiyamato, both of Japan

[73] Assignee: Citizen Watch Company Limited, Tokyo, Japan

[21] Appl. No.: 689,021

[22] Filed: May 24, 1976

[30] Foreign Application Priority Data

May 26, 1975 Japan ..... 50-61945
Aug. 14, 1975 Japan ..... 50-98808

[51] Int. Cl.[2] ..... G04C 3/00
[52] U.S. Cl. ..... 58/23 R; 58/85.5
[58] Field of Search ..... 58/23 R, 85.5

[56] References Cited

U.S. PATENT DOCUMENTS 3,948,035 4/1976 Kusumoto ..... 58/23 R

*Primary Examiner*—Stanley J. Witkowski
*Attorney, Agent, or Firm*—Frank J. Jordan

[57] ABSTRACT

A switch control unit for an electronic timepiece comprises a plurality of control switches and a sequence decoding circuit which detects sequences of actuations of the control switches to provide a plurality of output signals in dependence on varying combinations of sequences of actuations of the control switches. In modified form, the switch control unit comprises a plurality of control switches, a detecting circuit to detect numbers of actuations of each of the control switches thereby to provide outputs in dependence on varying combinations of numbers of actuations of the control switches, and a decoding circuit to decode the outputs from the detecting circuit to provide a plurality of output signals.

12 Claims, 9 Drawing Figures

FROM FREQUENCY CONVERTER 12
64Hz
A
B
C
60 A
62 AA
64 AB
66 B
68 BB
70 BA
20
22
22a
24
24a
25
26
28
29
30
31
32
33
34
35
36
37
38
39
40
42
43
44
45
46
48
50
52
54
54a
56
58

DISPLAY DEVICE
16
DECODER DRIVER 14
DECODER
14a
DISCRIMINATION CIRCUIT
CHATTERING PREVENTIVE CIRCUIT
18
20
26
A
B
C
D
60
62
64
66
68
70
72
74
76
78
80
82
84
86
88
90
92
94
R
13a
13b
13c
13d
13e
13f
SECONDS COUNTER
MINUTES COUNTER
HOURS COUNTER
DAYS OF WEEK COUNTER
DATE COUNTER
MONTH COUNTER
COUNTER 13
12
10
FREQUENCY CONVERTER
FREQUENCY STANDARD

SWITCH CONTROL UNIT FOR ELECTRONIC TIMEPIECE

This invention relates in general to electronic timepieces and, more particularly, to an electronic timepiece having a switch control unit adapted to provide a multiplicity of switching functions with the use of a plurality of control switches.

In general, modern electronic digital-display-type timepieces include integrated circuits and photo-electric display elements such as light-emitting diodes, electrochromism (EC), liquid crystals etc. These electronic timepieces usually provide various functions such as time setting or seconds zeroing, display mode switching, alarm setting, alarm time setting, starting or stopping operation of a chronograph, lap time setting, resetting of the chronograph, frequency adjustment, input or output operation of data in the electronic timepiece equipped with a memory circuit or calculator circuit, etc., in addition to their basic timekeeping function. It has also been proposed to provide multi-functions in electronic timepieces of the time-dial type in addition to the basic timekeeping function.

A problem is encountered with prior art electronic timepieces of the types described above, in that a relatively large number of control switches are necessarily incorporated in the watch case to perform various functions, resulting in an increased size of the electronic timepieces. To solve this problem, attempts have been made to provide various functions with the use of a minimum number of control switches. Typically one of these control switches is a crown, which is adapted to be axially movable in stepwise fashion and also rotatable in either direction to provide multi-switching functions.

Another expedient is to utilize the number of times of manual operation of the control switch, or the duration of a time interval in which the control switch is continuously operated. A problem is also encountered with this prior art expedient in that the circuit arrangement of the electronic timepiece will be complicated.

It is, therefore, an object of the present invention to provide an improved electronic timepiece having a simple switch control unit arranged to provide ease of manual operation to achieve various functions.

It is another object of the present invention to provide an improved electronic timepiece having a minimum number of control switches adapted to provide a plurality of switching functions.

It is still another object of the present invention to provide a switch control unit for an electronic timepiece having a minimum number of control switches, which switch control unit is arranged to provide a plurality of switching functions in dependence on varying combinations of sequences or numbers of operations of the control switches.

These and other objects, features and advantages of the present invention will become more apparent from the follwoing description when taken in conjunction with the accompanying drawings, in which.

Figure 1:
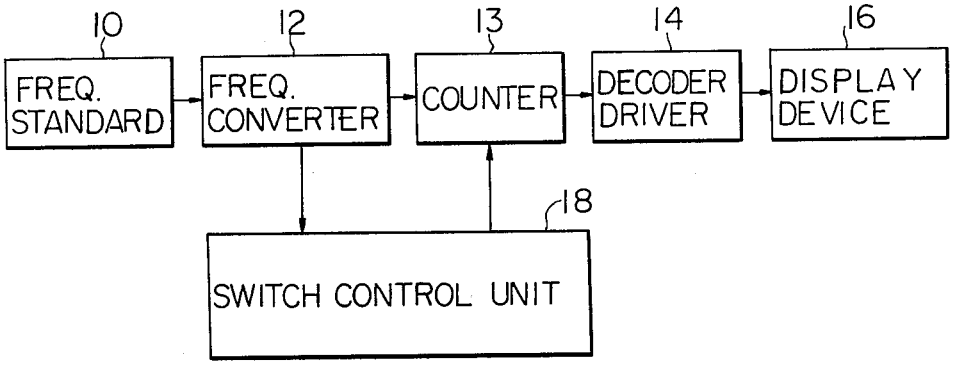
FIG. 1 is a block diagram of an electronic timepiece incorporating a switch control unit according to the present invention.

Referring now to FIG. 1, a schematic diagram is shown of an electronic timepiece incorporating a switch control unit according to the present invention. As shown, the electronic timepiece generally comprises a frequency standard 10, a frequency converter 12, a counter 13, a decoder driver 14 and a display device 16. The frequency standard 10 provides a high frequency time standard signal, which is applied to the frequency converter 12. The frequency converter 12 includes a plurality of binary counters (not shown), by which the high frequency signal is converted to a precise low frequency signal. This low frequency signal is applied through the counter 13 and decoder driver 14 to the display device 16 for the display of time. A switch control unit 18 is shown as connected to the frequency converter 12 to supply various pulses to the counter 13 for performing various functions such as time setting, seconds zeroing or display mode changes etc.

Figure 2:
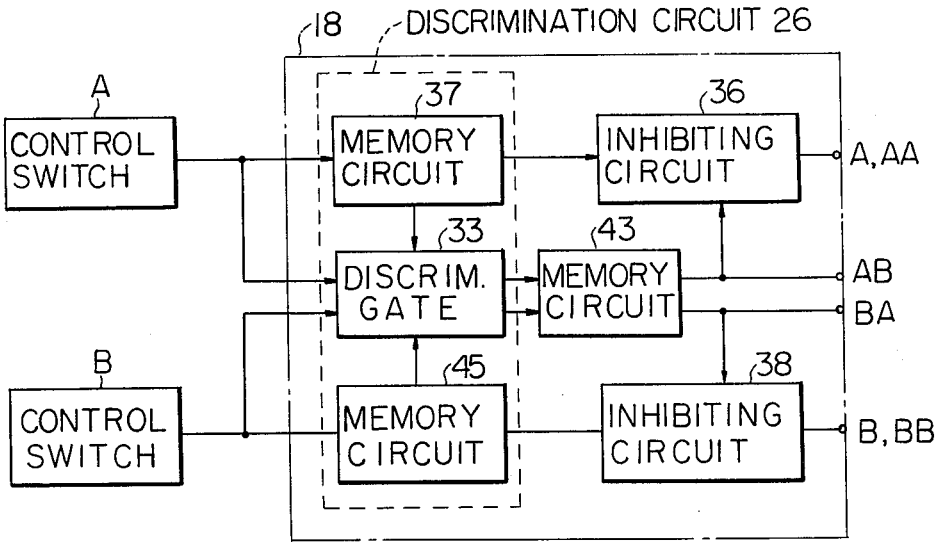
FIG. 2 is a block diagram of a preferred embodiment of the switch control unit shown in FIG. 1.

FIG. 2 shows a block diagram of the switch control unit 18. As shown, the switch control unit 18 comprises a plurality of control switches A and B, and a discrimination circuit 26. The discrimination circuit 26 includes a memory circuit 37 coupled to the switch control unit A and adapted to store the number of actuations of the control switch A, and a memory circuit 45 coupled to the control switch B and adapted to store the number of actuations of the control switch B. A discrimination gate 33 is coupled to the control switches A and B and controlled by the outputs of the memory circuits 37 and 45 to discriminate the sequences of the actuations of the control switches A and B to provide outputs representative of discriminated sequences of actuations of the control switches. The outputs of the discrimination gate 33 is stored in a memory circuit 43 whose outputs are coupled to terminals AB and BA. The outputs of the memory circuit 43 are also coupled to inhibiting circuits 36 and 38, to which the outputs of the memory circuits 37 and 45 are respectively coupled. The inhibiting circuit 36 is arranged to normally pass the outputs of the memory circuit 37 to a terminal indicated by A and AA, i.e., when the control switch A is depressed once and when the control switch A is consecutively depressed twice. However, when the output of the memory circuit 43 is applied to the inhibiting circuit 36, the inhibiting circuit 36 inhibits to pass the outputs of the memory circuit 37. Likewise, the inhibiting circuit 38 is arranged to normally pass the outputs of the memory circuit 45 to a terminal indicated by B and BB, i.e., when the control switch B is depressed once and when the control switch B is consecutively depressed twice. However, when the output of the memory circuit 43 is applied to the inhibiting circuit 38, it is inhibited to pass the outputs of the memory circuit 45.

Figure 3:
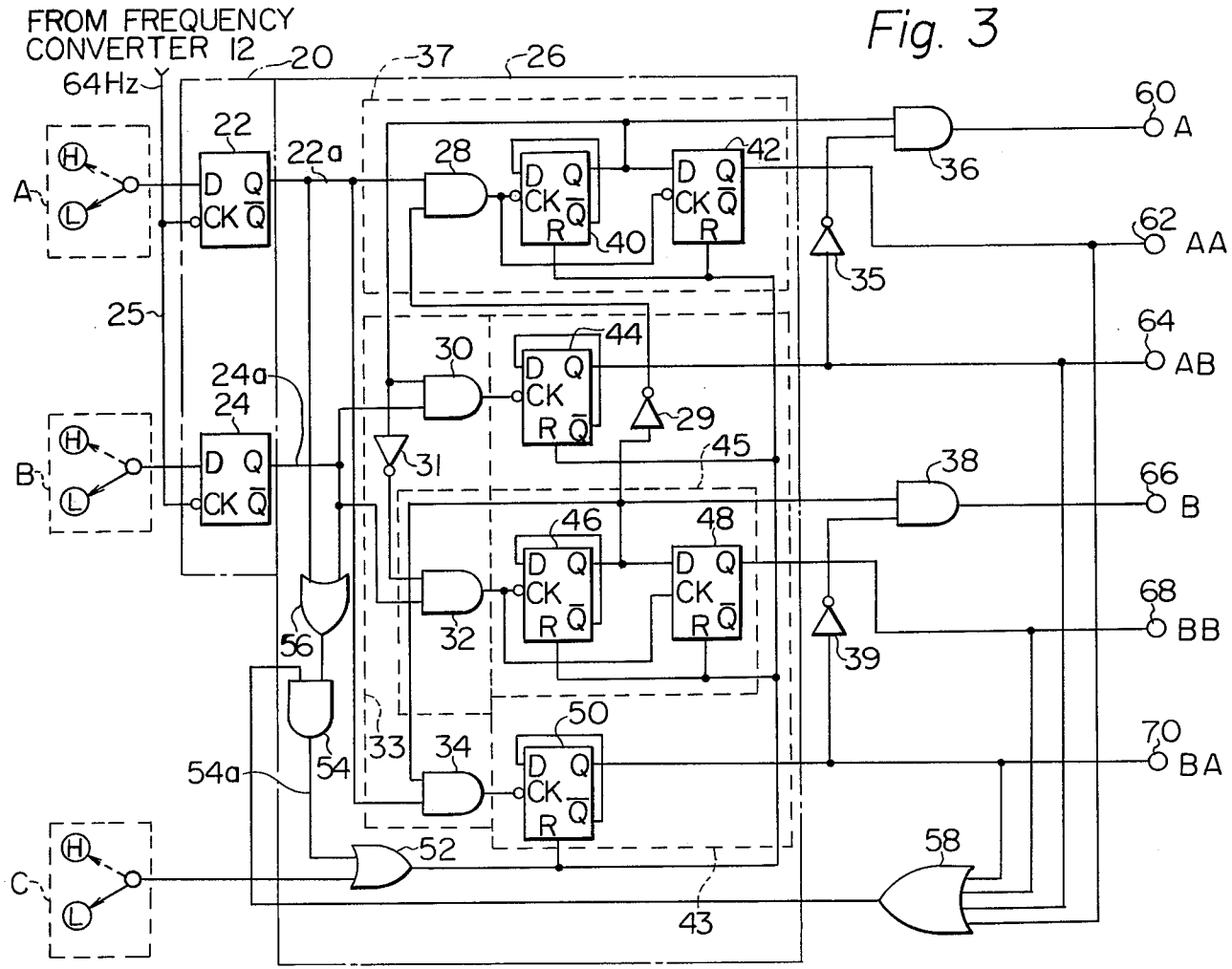
FIG. 3 is a detail circuitry of the switch control unit shown in FIG. 2.

A detail circuitry of the switch control switch is shown in FIG. 3, in which like or corresponding component parts are designated by the same reference numerals as those used in FIG. 2. As shown, the switch control unit 18 comprises first and second manually operable control switches A and B, and a third manually operable switch C serving as a reset switch, which are normally held in low level condition. The first and second control switches A and B are coupled to a chattering preventive circuit 20.

The chattering preventive circuit 20 comprises first and second trailing edge-triggered data-type flip-flops 22 and 24 having their data terminals coupled to the first and second control switches A and B, respectively. The clock terminals of the flip-flops 22 and 24 are coupled through a lead 25 to a frequency converter 12 to receive a 64 Hz signal therefrom. This serves as means for preventing switch bounce caused by the control switches A and B, respectively, while synchronizing input signals from the control switches A and B with the 64 Hz signal from the frequency converter 12. The flip-flops 22 and 24 have Q outputs coupled to a discrimination circuit 26.

The discrimination circuit 26 comprises AND gates 28, 30, 32, and 34, and trailing edge-triggered data-type flip-flops 40, 42, 44, 46, 48 and 50. The AND gate 28 has one of its inputs coupled through a lead **22*a* to the Q output of the data-type flip-flop 22 and its other input coupled through a inverter 29 to the Q output of the data-type flip 46 of a memory circuit 45, to which inputs of the AND gates 34 and 38 are also connected. The AND gate 28 output is coupled to the clock terminals of the flip-flops 40 and 42 of a memory circuit 37. The data terminal of the flip-flop 40 is coupled to the $\overline{Q}$ output of the flip-flop 40, whose Q output is coupled to the data terminal of the flip-flop 42. The Q output of flip-flop 42 is coupled to a terminal 62. The Q output of the flip-flop 40 is also coupled to one input of the AND gate 36 serving as an inhibiting circuit having its other input coupled through an inverter 35 to the Q output of the flip-flop 44 forming part of a memory circuit 43. The AND gate 36 also has an output coupled to a terminal 60. As shown, the Q output of the flip-flop 40 is also coupled to one input of the AND gate 30 forming part of a discriminating circuit 33 and having its other input coupled to a lead 24*a* coupled to the Q output of the flip-flop 24, and coupled through an inverter 31 to one input of the AND gate 32 having its other input coupled to the lead 24*a*. The AND gate 30 has an output coupled to a clock terminal of the flip-flop 44 of the memory circuit 43, whose data terminal is coupled to the $\overline{Q}$ output of the flip-flop 44. The flip-flop 44 also has its Q output coupled to a terminal 64. An output of the AND gate 32 is coupled to a clock terminal of the flip-flop 46 forming part of the memory circuit 45, whose data terminal is coupled to the $\overline{Q}$ output of the flip-flop 46. The Q output of the flip-flop 46 is coupeld to a data terminal of the flip-flop 48 which forms part of the memory circuit 45 and the AND gates 34 and 38. The AND gate 38, which serves as an inhibiting circuit, also has its other input coupled through an inverter 39 to the Q output of the flip-flop 50 forming part of the memory circuit 43 which is connected to a terminal 70, and an output coupled to a terminal 66. The flip-flop 48 has its Q output coupled to a terminal 68. The AND gate 34 has one input coupled to the lead 22*a* and the other coupled to the Q output of the flip-flop 46. The output of AND gate 34 is coupled to the clock terminal of the flip-flop 50, whose data terminal is coupled to the $\overline{Q}$ output of the flip-flop 50. The reset switch C is coupled to one input of an OR gate 52, whose other input is coupled to an output 54*a* of an AND gate 54. The AND gate 54 has one of its inputs coupled to the output of an OR gate 56, the inputs to which are coupled to the leads 22*a* and 24*a*. The other input of the AND gate 54 is coupled to an output of an OR gate 58 having its inputs coupled to the Q outputs of the flip-flops 42, 44, 48 and 50. The output of the OR gate 52 is coupled to the reset terminals of the flip-flops 40, 42, 44, 46, 48 and 50, so as to reset these flip-flops when the output of the OR gate 52** becomes high level.

The relationship between the sequences of actuations of the control switches and the logic levels of the output terminals is indicated in the following Table 1:

Table 1

| Mode | Sequences of actuations of control switches A and B | Logic level at output terminals 60 | 62 | 64 | 66 | 68 | 70 |
|---|---|---|---|---|---|---|---|
| 1 | Switch A actuated once (A) | H | L | L | L | L | L |
| 2 | Switch A actuated second times (AA) | L | H | L | L | L | L |
| 3 | Switch B actuated once after depression of switch A (AB) | L | L | H | L | L | L |
| 4 | Switch B actuated once (B) | L | L | L | H | L | L |
| 5 | Switch B actuated twice (BB) | L | L | L | L | H | L |
| 6 | Switch A actuated once after depression of switch B (BA) | L | L | L | L | L | H |

Figure 5:
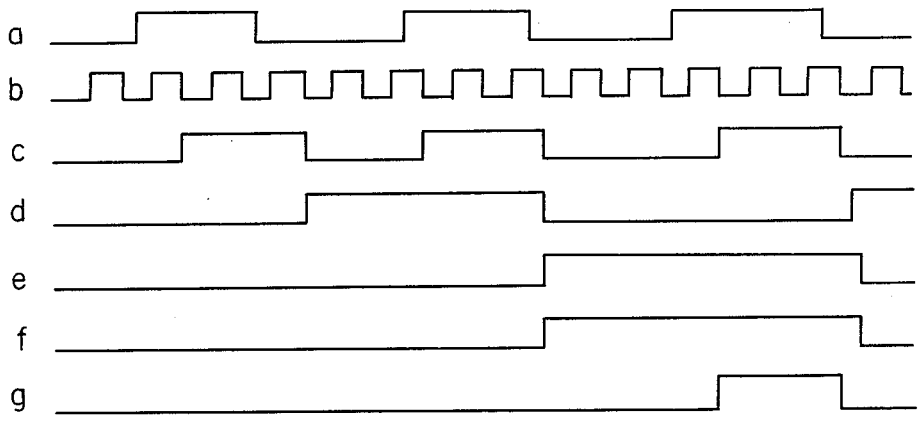
FIGS. 5 and 6 are waveform diagrams for the circuitry shown in FIG. 3.

When, the control switch A is actuated as shown by a waveform *a* in FIG. 5, the flip-flop 22 generates an output as shown by a waveform *c* in FIG. 5 which rises and falls at the trailing edges of the output pulses shown by a waveform *b* in FIG. 5. Since, in this instance, the AND gate 28 is opened by the action of the inverter 29, the output of the flip-flop 22 is applied to the clock terminal of the flip-flop 40 which consequently generates an output as shown by a waveform *d* in FIG. 5. This output is applied to the AND gate 36. The AND gate 36 is at this time opened by the action of the inverter 35, so that the output from the flip-flop 40 is gated therethrough and applied to the terminal 60. When the control switch A is depressed a second time, the flip-flop 42 generates an output as shown by a waveform *e* in FIG. 5 which is applied to the output terminal 62. This output is also applied to the OR gate 58, whose output is shown by a waveform *f* in FIG. 5.

When, further, the control switch A is actuated a third time, the output of the flip-flop 22 is applied through the OR gate 56 to one input of the AND gate 54, to which the output of the flip-flop 42 is also applied through the OR gate 58. Thus, the AND gate 54 generates an output as shown by a waveform *g* in FIG. 5, which is applied through the OR gate 52 to the reset terminal of the flip-flops 40, 42, 44, 46, 48 and 50, thereby resetting these flip-flops.

Figure 6:
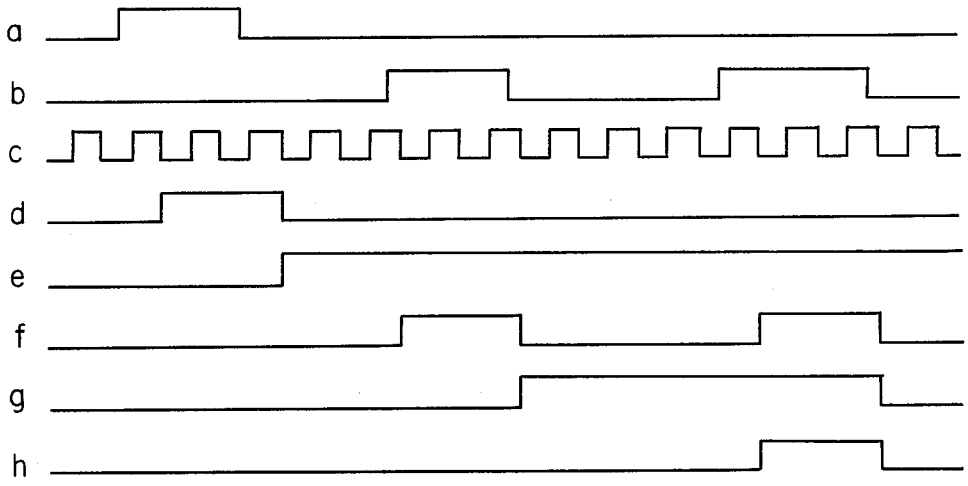

It should be understood that when the control switch A is actuated once as shown by a waveform *a* in FIG. 6 the output of the flip-flop 40 enables the AND gate 30 while inhibiting the AND gate 32. Accordingly, when the control switch B is actuated as shown by a waveform *b* in FIG. 6 after depression of the control switch A, the output of the flip-flop 24 is gated through the AND gate 30 to the clock terminal of the flip-flop 44, which consequently generates an output as shown by a waveform *g* in FIG. 6. This output is applied to the output terminal 64. Subsequently, if the control switch B is actuated again as shown by the waveform *b* in FIG. 6, the output of the flip-flop 24 is gated through the OR gate 56 and the AND gate 54 to the reset terminals of the flip-flops 40, 42, 44, 46, 48 and 50 to reset these flip-flops. The waveform of the resetting pulse is shown by a symbol *h* in FIG. 6. The waveforms *d, e* and *f* in FIG. 6 indicate outputs of the flip-flops 22, 40 and 24, respectively.

When the control switch B is initially actuated, the flip-flop 24 generates an output which is applied to the AND gates 30 and 32. In this instance, the AND gate 30 is inhibited and the AND gate 32 is opened by the action of the inverter 31. Consequently, the output of the flip-flop 24 is gated through the AND gate 32 to the clock terminal of the flip-flop 46, which generates an output. This output is gated through the AND gate 38 to the output terminal 66.

When the control switch B is actuated a second time, the flip-flop 48 generates an output which is applied to the output terminal 68.

It should be noted that when the control switch B is initially actuated the output of the flip-flop 46 is applied through the inverter 29 to inhibit the AND gate 28 and applied directly to the AND gate 34, opening this gate. The operating sequence of the control switches A and B is thereby detected. Accordingly, if the control switch A is actuated after actuation of the control switch B, the output of the flip-flop 22 is gated through the AND gate 34 to the clock terminal of the flip-flop 50 which consequently generates an output. This output is applied to the output terminal 70.

The control switch C serves to reset all of the flip-flops 40, 42, 44, 46, 48 and 50 irrespective of the switching sequence of the control switches A and B.

It will thus be seen that since the sequence of actuation of the control switches A and B is detected by the discrimination circuit 26, providing different switching functions as indicated by Modes 3 and 6 in Table 1, it is possible to provide a number of switching functions with the use of a minimum number of control switches as well as minimal number of switch operations. In addition, since the discrimination circuit 26 is arranged to be reset when either one of or both of the control switches A and B are actuated a predetermined number of times, the switch control unit is simple in circuit arrangement and the reset switch may be dispensed with if desired. It should be noted that the AND gates 28, 30, 32 and 34 and the trailing edge-triggered data-type flip-flops 22, 24, 40, 44, 46, 48 and 50 may be replaced by NAND gates and leading edge-triggered data-type flip-flops.

The sequences of operation of the control switches A, B and C may be combined as exemplified in the following Table 2:

Table 2

| Case 1 | Case 2 | Case 3 |
|---|---|---|
| A B C | A B | A |
| A C B | A C | A B |
| B A C | B A | A C |
| B C A | B C | A B C |
| C A B | C A | B |
| C B A | C B | B A |
| — | — | B C |
| — | — | B C A |
| — | — | C |
| — | — | C A |
| — | — | C B |
| — | — | C A B |

In Table 2, case 1 represents one example in which all of the three control switches are actuated in varying sequences. Case 2 indicates another example in which two of the control switches are actuated in varying sequences. Case 3 indicates another example of varying combinations of operating sequence of the control switches.

Figure 4:
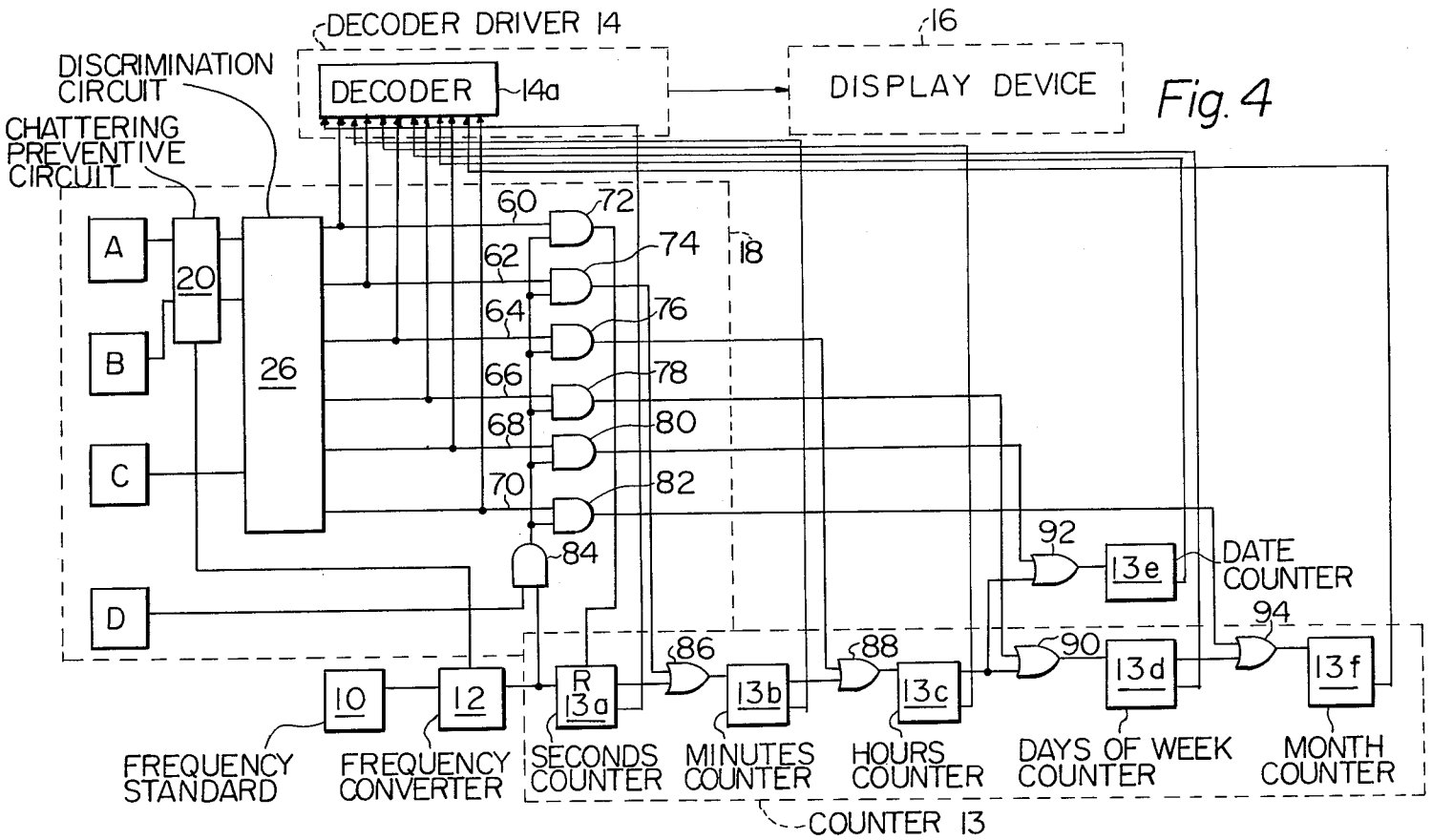
FIG. 4 is a schematic circuit diagram illustrating an example of an electronic timepiece incorporating the switch control unit according to the present invention.

An example of an electric circuitry for an electronic timepiece incorporating the switch control unit according to the present invention is illustrated in FIG. 4, in which like or corresponding component parts are designated by the same reference numerals as those used in FIGS. 1, 2 and 3. In this application, the output terminals 60, 62, 64, 66, 68 and 70 of the switch control unit 26 are coupled to a decoder 14*a* of a decoder driver 14 so that digits to be corrected are displayed by a display device 16. The output terminal 60, 62, 64, 66, 68 and 70 are also coupled to inputs of AND gates 72, 74, 76, 78, 80 and 82 having other inputs coupled to an output of an AND gate 84. The AND gate 84 has one input coupled to the output of the frequency converter 12 and the other input coupled to a set switch D. The AND gate 72 has an output coupled to a reset terminal of a second counter 13*a*. The AND gates 74, 76, 78, 80 and 82 have outputs coupled through OR gates 86, 88, 90, 92 and 94 to minutes counter 13*b*, hours counter 13*c*, days of the week counter 13*d*, date counter 13*e* and month counter 13*f*. Thus, the seconds counter 13*a*, minutes counter 13*b*, hours counter 13*c*, days of the week counter 13*d*, date counter 13*e* and month counter 13*f* are arranged to be corrected in response to outputs A, AA, AB, B, BB and BA applied to the output terminals 60, 62, 64, 66, 68 and 70, respectively.

When, in operation, one of the output terminals becomes high level by actuating the control switches A and B, selected digit to be corrected is decoded by the decoder 14*a* and displayed by the display device 16. On the other hand, the AND gates 72, 74, 76, 78, 80 and 82 are opened when the associated output terminals become high level. If, in this instance, the set switch D is actuated, the AND gate 84 is opened to pass higher frequency signals from the frequency converter 12. These higher frequency signals are gated through the AND gates 72, 74, 76, 78, 80 and 82 to the seconds counter 13*a*, minutes counter 13*b*, hours counter 13*c*, days of the week counter 13*d*, date counter 13*e* and month counter 13*f*, respectively. In this manner, the second zeroing is performed, and minutes, hours, days of the week, date and month are corrected.

Figure 7:
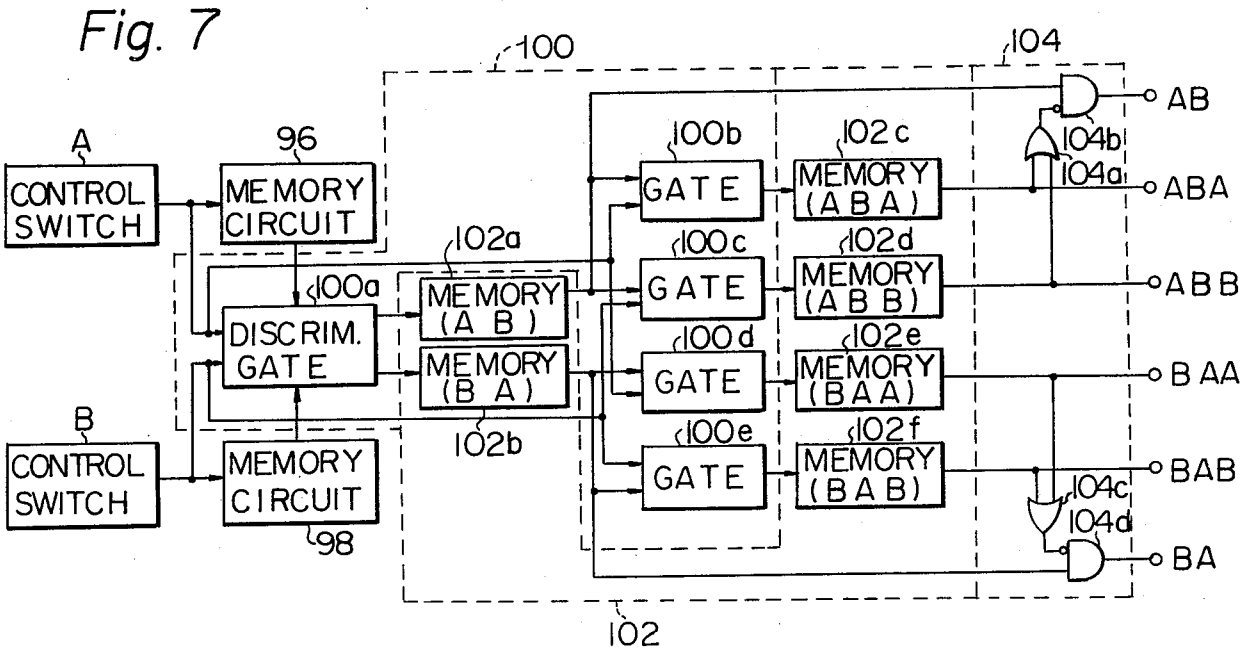
FIG. 7 is a block diagram illustraing a modified form of the switch control unit shown in FIG. 3.

FIG. 7 shows a modified form of the switch control unit shown in FIGS. 1, 2 and 3. In this modified form, the control switches A and B are coupled to memory circuits 96 and 98 adapted to store the number of actuations of the control switches A and B, respectively. The control switches A and B are also coupled to a sequence discrimination circuit 100*a* of a sequence discrimination unit 100. The sequence discrimination circuit 100*a* serves to detect sequences of actuations of the control switches A and B and generate outputs indicating the sequences of actuations of the control switches, which are stored in sequence memory circuits 102*a* and 102*b* of a sequence memory unit 102. The outputs of the memory circuits 102*a* and 102*b* are supplied to sequence discimination gates 102*c* and 102*d* and sequence discrimination gates 100*d* and 100*e*, respectively. The control switch A is coupled to the sequence discrimination gates 100*b* and 100*d*, and the control switch B is coupled to the sequence discrimination gates 100*c* and 100*e*. The outputs of the sequence memory circuits 102*a* and 102*b* are also coupled through an output inhibiting unit 104 to output terminals AB and BA, respectively.

The sequence discrimination gate 100b generates an output ABA in response to the output from the memory circuit 102a and the output from the control switch A. The output ABA is stored in a sequence memory circuit 102c, whose output is coupled to an output terminal ABA and coupled through an OR gate 104a to an inverted input of an inhibiting AND gate 104b. Thus, when the output terminal ABA goes to high level, the AND gate 104b is inhibited.

The sequence discrimination gate 100c generates an output ABB in response to the output from the memory circuit 102a and the output from the control switch B. The output ABB is stored in a sequence memory circuit 102d, whose output is coupled to an output terminal ABB and coupled through the OR gate 104a to the inverted input of the inhibiting AND gate 104b.

Similarly, the sequence discrimination gate 100d generates an output BAA in response to the output from the memory circuit 102a and the output from the control switch A. The output BAA is stored in a sequence memory circuit 102e, whose output is coupled to an output terminal BAA and coupled through an OR gate 104c to an inverted input of an inhibiting AND gate 104d.

The sequence discrimination gate 100e generates an output BAB in response to the output from the memory circuit 102b and the output from the control switch B. The output BAB is stored in a sequence memory circuit 102f, whose output is coupled to an output terminal BAB and coupled through the OR gate 104c to the inverted input of the AND gate 104d.

It will thus be seen that various outputs can be obtained in dependence on the sequences of actuations of the control switches A and B.

Figure 8:
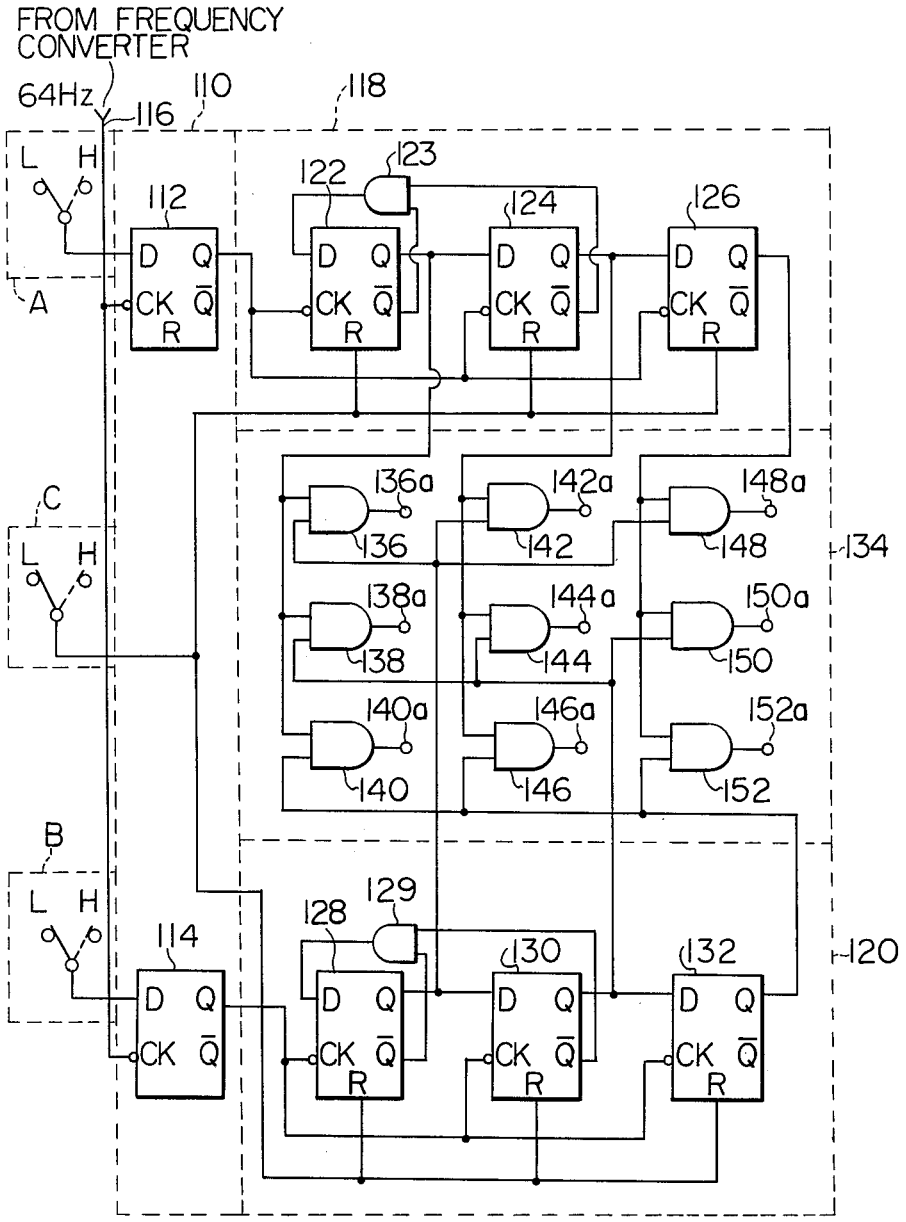
FIG. 8 is detail circuitry of another preferred embodiment of the switch control unit according to the present invention.

FIG. 8 shows another preferred embodiment of the switch control unit adapted to provide a plurality of outputs in dependence on varying combinations of numbers of control switch actuations. In this illustrated embodiment, the switch control unit comprises first and second control switches A and B, and a reset switch C. The first and second control switches A and B are coupled to a chattering preventive circuit 110 including first and second trailing edge-triggered data-type flip-flops 112 and 114. These flip-flops 112 and 114 have data terminals coupled to the control switches A and B, respectively, and clock terminals coupled through a lead 116 to a frequency converter to receive pulses at a frequency of 64 Hz therefrom. The first and second flip-flops 112 and 114 have Q outputs coupled to first and second shift registers 118 and 120.

Shift registers 118 and 120 comprise a plurality of trailing edge-triggered data-type flip-flops 122, 124, 126, 128, 130 and 132. A decoding circuit 134 comprises a plurality of AND gates 136, 138, 140, 142, 144, 146, 148, 150 and 152. The Q output of the flip-flop 112 is coupled in parallel to clock terminals of the flip-flops 122, 124 and 126. The flip-flop 122 has its data terminal coupled to an output of an AND gate 123. The AND gate 123 has its inputs coupled to the Q outputs of the flip-flops 122 and 124. The Q output of the flip-flop 122 is coupled to the data terminal of the flip-flop 124 and inputs of the AND gates 136, 138 and 140. The Q output of the flip-flop 124 is coupled to the data terminal of the flip-flop 126 and inputs of the AND gates 142, 144 and 146. The Q output of the flip-flop 126 is coupled to inputs of the AND gates 148, 150 and 152.

Similarly, the Q output of the flip-flop 114 is coupled in parallel to the clock terminals of the flip-flops 128, 130 and 132. The flip-flop 128 has its data terminal coupled to an output of AND gate 129. The inputs of AND gate 129 is coupled to the $\bar{Q}$ outputs of the flip-flops 128 and 130. The Q output of flip-flop 128 is coupled to the data terminal of the flip-flop 130 and the remaining inputs of the AND gates 136, 142, and 148. The flip-flop 130 has its Q output coupled to the data terminal of the flip-flop 132 and the remaining inputs of the AND gates 138, 144 and 150. The flip-flop 132 has its Q output coupled to inputs of the AND gates 140, 146, and 152. The reset terminals of the flip-flops 122, 124, 126, 128, 130 and 132 are coupled to the reset switch C.

The relationship between the varying combinations of number of actuations of the control switches A and B and the logic levels of the output terminals is indicated in the following Table 3:

Table 3

| | Varying combinations of numbers of actuations | | | | | | Logic levels at output terminals | | | | | | | | |
|---|---|---|---|---|---|---|---|---|---|---|---|---|---|---|---|
| | Switch A | | | Switch B | | | | | | | | | | | |
| Mode | 1 | 2 | 3 | 1 | 2 | 3 | 136a | 142a | 148a | 138a | 144a | 150a | 140a | 146a | 152a |
| 1 | 0 | | | 0 | | | H | L | L | L | L | L | L | L | L |
| 2 | | 0 | | 0 | | | L | H | L | L | L | L | L | L | L |
| 3 | | | 0 | 0 | | | L | L | H | L | L | L | L | L | L |
| 4 | 0 | | | | 0 | | L | L | L | H | L | L | L | L | L |
| 5 | | 0 | | | 0 | | L | L | L | L | H | L | L | L | L |
| 6 | | | 0 | | 0 | | L | L | L | L | L | H | L | L | L |
| 7 | 0 | | | | | 0 | L | L | L | L | L | L | H | L | L |
| 8 | | 0 | | | | 0 | L | L | L | L | L | L | L | H | L |
| 9 | | | 0 | | | 0 | L | L | L | L | L | L | L | L | H |

Figure 9:
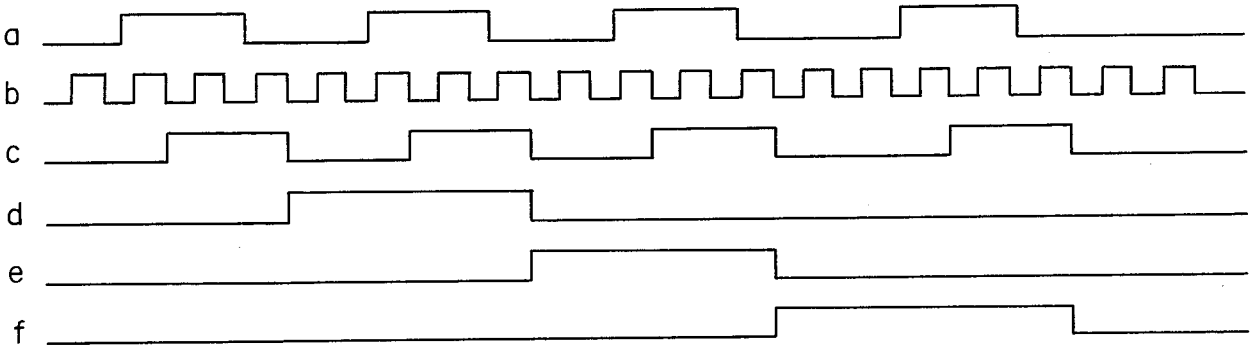
FIG. 9 is a waveform diagram for the circuitry shown in FIG. 8.

In Table 3, the symbol "0" indicates switch actuations. When the control switch A is actuated as shown in the timing chart *a* of FIG. 9, the flip-flop 112 generates an output as shown by a waveform *c* in FIG. 9 at the trailing edges of the 64 Hz pulses shown by a waveform *b* in FIG. 9. The same result is obtained when the control switch B is actuated. The output from the flip-flop 112 is applied to the clock terminal of the flip-flop 122, which consequently generates an output as shown by a waveform *d* in FIG. 9. This output is applied to the data terminal of the flip-flop 124, which generates an output as shown by a waveform *e* in FIG. 9. This output is applied to the data terminal of the flip-flop 126, which generates an output as shown by a waveform *f* in FIG. 9. In this manner, the outputs of the flip-flops 122, 124 and 126 are shifted to the right, as viewed in FIG. 8, each time the control switch A is actuated. The same result will be obtained when the control switch B is actuated several times, and the outputs of the flip-flops 128, 130 and 132 are similar to those shown by waveforms *d, e* and *f* in FIG. 9.

When the control switches A and B are actuated once, respectively, as shown in Mode 1 of Table 3, the outputs of the flip-flops 122 and 128 are applied to the AND gate 136. Thus, the AND gate 136 generates an output at its terminal 136*a*.

When the control switch A is actuated twice and the control switch B is actuated once as indicated in Mode 2 of the Table 3, the outputs of the flip-flops 124 and 128 are applied to the AND gate 142. Thus, the AND gate 142 generates an output at its terminal 142*a*.

When the control switch A is actuated three times and the control switch B is actuated once as, indicated in Mode 3 of Table 3, the outputs of the flip-flops 126 and 128 are applied to the AND gate 148 which consequently generates an output at its terminal 148*a*.

When the combinations of actuations of the control switches A and B are varied, the logic levels at respective output terminals will vary as shown in Table 3.

It is to be noted that the output terminals of the switch control unit may be coupled to input terminals for time correction or various control functions in the electronic timepiece. In this case, it is possible to perform time correction or control of various functions by depressing the control switches A and B by varying number of times less than three times. When a required time correction or control of a particular function is completed, the reset switch C is depressed to reset all the flip-flops of the switch control unit. In actual practice, since the output terminal 136*a* immediately goes to the high level when the control switch A is depressed once, while the control switch B must be depressed twice to set the output terminal 138*a* to the high level, it is preferable that the decoding circuit 134 be provided with additional circuits such as timers. Time correction can be thereby be performed at a predetermined time instant after a selected output terminal has gone to the high level. In this case, the timers may be coupled to the Q outputs of the flip-flops 128, 130 and 132 and additional circuits may be coupled to the control switches A and B to provide priority operation of these switches. The result of this is that even when the control switch B is depressed, an input signal is not applied to the chattering preventive circuit 110 unless the control switch A has been initially depressed. It is thus possible to generate an output of a particular output terminal without causing other output terminals to immediately go to the high level, when the control switches are actuated.

It will now be appreciated from the foregoing description that in accordance with the present invention a plurality of switching functions can be provided with the use of a minimum number of control switches, whereby the circuit arrangement of an electronic timepiece can be simplified.

While the present invention has been shown and described with reference to particular embodiments, it should be understood that other various changes or modifications may be made without departing from the scope of the present invention.

What is claimed is:

1. A switch control unit for an electronic timepiece comprising:

a first control switch adapted to provide a first output pulse when actuated;

a second control switch adapted to provide a second output pulse when actuated;

a first memory circuit connected to said first control switch and including circuit means for storing said first output pulse when said first control switch is actuated before said second control switch is actuated, the circuit means of said first memory circuit generating a first output in response to said first output pulse stored in the circuit means of said first memory circuit;

a second memory circuit connected to said second control switch and including circuit means for storing said second output pulse when said second control switch is actuated before said first control switch is actuated, the circuit means of said second memory circuit generating a second output in response to said second output pulse stored in the circuit means of said second memory circuit; and discrimination gate means including a first gate responsive to said first output and said second output pulse for thereby generating a first output signal representative of a first sequence of actuations of said first and second control switches, and a second gate responsive to said second output and said first output pulse for thereby generating a second output signal representative of a second sequence of actuations of said first and second control switches.

2. A switch control unit according to claim 1, in which the circuit means of said first memory circuit comprises gate means having one input coupled to said first control switch and the other input coupled to the circuit means of said second memory circuit through an inverter whereby said gate means passes said first output pulse to said first memory circuit in the absence of said second output, and a flip-flop connected to an output of said gate means to generate said first output in response to said first output pulse.

3. A switch control unit according to claim 1, in which the circuit means of said second memory circuit comprises gate means having one input coupled to said second control switch and the other input coupled to the circuit means of said first memory circuit through an inverter whereby said gate means passes said second output pulse to said second memory circuit in the absence of said first output, and a flip-flop connected to an output of said gate means to generate said second output in response to said second output pulse.

4. A switch control unit according to claim 1, in which said discrimination gate means further comprises a first flip-flop responsive to an output of said first gate for generating said first output signal.

5. A switch control unit according to claim 4, in which said discrimination gate means further comprises a second flip-flop responsive to said second gate for generating said second output signal.

6. A switch control unit according to claim 1, further comprising means for resetting the circuit means of said first and second memory circuits when said first and second control switches are actuated a predetermined number of times.

7. A switch control unit according to claim 6, further comprising a reset switch coupled to said resetting means for thereby resetting the circuit means of said first and second memory circuits when said reset switch is actuated.

8. A switch control unit for an electronic timepiece comprising:

a first control switch adapted to provide a first output pulse when actuated;

a second control switch adapted to provide a second output pulse when actuated;

a first memory circuit connected to said first control switch and including circuit means for storing said first output pulse when said first control switch is actuated before said second control switch is actuated, the circuit means of said first memory circuit generating a first output signal in response to said first output pulse stored therein;

a second memory circuit connected to said second control switch and including circuit means for storing said second output pulse when said second control switch is actuated before said first control switch is actuated, the circuit means of said second memory circuit generating a second output signal in response to said second output pulse stored therein;

discrimnation gate means including a first gate responsive to said first output signal and said second output pulse for thereby generating a third output signal representative of a first sequence of actuations of said first and second control switches, and a second gate responsive to said second output signal and said first output pulse for thereby generating a fourth output signal representative of a second sequence of actuations of said first and second control switches.

9. A switch control unit according to claim 8, further comprising a first inhibiting gate having one input coupled to said first memory circuit and the other input coupled through an inverter to said discrimination gate means for inhibiting the supply of said first output signal in the presence of said third output signal, and a second inhibiting gate having one input coupled to said second memory circuit and the other input coupled through an inverter to said discrimination gate means for inhibiting the supply of said second output signal in the presence of said fourth output signal.

10. A switch control unit for an electronic timepiece comprising:

a first control switch adapted to provide a first output pulse each time the first control switch is actuated;

a second control switch adapted to provide a second output pulse each time the second control switch is actuated;

a first shift register connected to said first control switch and composed of a plurality of flip-flops arranged to generate a plurality of outputs representative of the number of actuations of said first control switch, respectively;

a second shift register connected to said second control switch and composed of a plurality of flip-flops arranged to generate a plurality of outputs representative of the number of actuations of said second control switch, respectively, and a decoding circuit composed of a plurality of groups of gate circuits, each group of said gate circuits having first inputs connected in common to one of said flip-flops of said first shift register, and second inputs connected to said flip-flops of said second shift register, respectively, each of said gate circuits decoding the outputs from said first and second shift registers for thereby generating an output signal representative of a combination of the number of actuations of said first control switch and the number of actuations of said second control switch.

11. A switch control unit according to claim 10, wherein the flip-flops of said first and second shift registers have reset terminals, further comprising a reset switch coupled to said reset terminals for resetting these flip-flops when said reset switch is actuated.

12. A switch control unit according to claim 10, in which each of said flip-flops comprises a data-type flip-flop.

* * * * *